US012031761B2

(12) United States Patent
Kim

(10) Patent No.: US 12,031,761 B2
(45) Date of Patent: Jul. 9, 2024

(54) METHOD OF CONTROLLING ICE-DETACHING TEMPERATURE OF ICEMAKER

(71) Applicant: DAEYEONG E&B CO., LTD., Gyeonggi-do (KR)

(72) Inventor: Doo Ha Kim, Incheon (KR)

(73) Assignee: Bluenix Co., Ltd (KR)

( * ) Notice: Subject to any disclaimer, the term of this patent is extended or adjusted under 35 U.S.C. 154(b) by 46 days.

(21) Appl. No.: 17/128,793

(22) Filed: Dec. 21, 2020

(65) Prior Publication Data

US 2022/0057128 A1 Feb. 24, 2022

(30) Foreign Application Priority Data

Aug. 18, 2020 (KR) ..... 10-2020-0103206

(51) Int. Cl.
*F25C 1/12* (2006.01)

(52) U.S. Cl.
CPC ..... *F25C 1/12* (2013.01); *F25C 2600/02* (2013.01); *F25C 2700/12* (2013.01)

(58) Field of Classification Search
CPC .... F25C 1/12; F25C 2600/02; F25C 2700/12; F25C 1/04; F25C 5/04; F25C 2600/04;
(Continued)

(56) References Cited

U.S. PATENT DOCUMENTS

2006/0266056 A1* 11/2006 Chang et al. ..... F25C 1/00 62/135

2013/0174587 A1* 7/2013 Lee ..... F25C 1/00 62/73

(Continued)

FOREIGN PATENT DOCUMENTS

CN 20150115988 A * 10/2015 ..... F25C 1/22
JP 05-10641 1/1993

(Continued)

OTHER PUBLICATIONS

JP2017110844A Translation (Year: 2017).*

(Continued)

*Primary Examiner* — Elizabeth J Martin
*Assistant Examiner* — Dario Antonio Deleon
(74) *Attorney, Agent, or Firm* — The Farrell Law Firm, P.C.

(57) ABSTRACT

Provided is a method of controlling an ice-detaching temperature of an icemaker, including a first step of performing an ice-making operation in an ice-making unit, and counting a required ice-making time period from a starting point in time of the ice-making operation to an end point in time of the ice-making operation; a second step of acquiring the counted required ice-making time period, and acquiring an ambient temperature from an external temperature sensor; a third step of determining a variable ice-detaching time period, depending on the acquired ambient temperature and the acquired required ice-making time period; and a fourth step of using the determined ice-detaching time period to perform an ice-detaching operation. Ice of a cold plate is completely separated from the cold plate during an ice-detaching operation under conventional temperature conditions and even under harsh environments, preventing ice-maker failure and increasing ice-making capacity.

7 Claims, 4 Drawing Sheets

(58) Field of Classification Search
CPC ..... F25C 5/02; F25C 1/25; F25C 2400/10; F25C 2700/00
See application file for complete search history.

(56) References Cited

U.S. PATENT DOCUMENTS

| | | | | |
|---|---|---|---|---|
| 2018/0164016 | A1* | 6/2018 | Oh | F25C 5/18 |
| 2019/0178551 | A1* | 6/2019 | Cheon | F25C 1/25 |

FOREIGN PATENT DOCUMENTS

| | | | | | |
|---|---|---|---|---|---|
| JP | 2016033442 | A | * | 3/2016 | F25C 1/04 |
| JP | 2017110844 | A | * | 6/2017 | F25C 1/22 |
| JP | 2020118321 | A | * | 8/2020 | F25C 1/25 |
| KR | 101281587 | B1 | * | 7/2013 | F25C 2700/12 |
| KR | 101483028 | B1 | * | 1/2015 | F25C 5/08 |
| KR | 1020150115988 | | | 10/2015 | |
| KR | 1020180066451 | | | 6/2018 | |

OTHER PUBLICATIONS

KR20150115988A Translation (Year: 2015).*
JP2020118321A Translation (Year: 2020).*
JP2016033442A Translation (Year: 2016).*
KR 101483028 B1 Translation (Year: 2015).*
KR 101281587 B1 Translation (Year: 2013).*
Korean Office Action dated Oct. 27, 2021 issued in counterpart application No. 10-2020-0103206, 4 pages.

* cited by examiner

METHOD OF CONTROLLING ICE-DETACHING TEMPERATURE OF ICEMAKER

CROSS-REFERENCE TO RELATED APPLICATION(S)

This application claims benefit of priority to Korean Patent Application No. 10-2020-0103206 filed on Aug. 18, 2020 in the Korean Intellectual Property Office, the content of which is incorporated herein by reference in its entirety.

BACKGROUND

1. Field

The present disclosure relates to a method of controlling an ice-detaching temperature of an icemaker, and, more particularly, to a method of controlling an ice-detaching temperature of an icemaker by controlling an ice-detaching time period and an operation of an ice-making water pump, depending on a temperature.

2. Related Art

A batch type icemaker is an icemaker that may alternately repeat an ice-making operation of making ice on a cold plate and an ice-detaching operation of separating the formed ice from the cold plate. In this regard, ice-making capacity of the icemaker may be determined by a daily ice production volume. In particular, ice-making capacity of the batch type icemaker may be mainly determined by how short a required ice-making time period and an ice-detaching time period are kept.

In the ice-making operation, water required for ice-making may be supplied to a water tank by a water supply valve, and capacity of the water tank may match an amount of ice to be made once. When water is filled in the water tank, an ice-making water pump may operate to supply the water to a cold plate, and a refrigeration cycle may proceed at the same time. At this time, the cold plate may become cold by the refrigeration cycle and the water flowing on the cold plate may turn into ice. That is, the lower a water supply temperature, the shorter a time period for the water to reach a freezing temperature and the shorter a required ice-making time period.

On the other hand, in the ice-detaching operation, a high-temperature and high-pressure refrigerant discharged from a compressor by a hot gas valve may enter the cold plate to simultaneously increase a temperature of the cold plate, a portion of ice touching a surface of the cold plate may start to melt, and the partially melted ice on the cold plate may be separated from the cold plate and moved into an ice reservoir. That is, contrary to the ice-making operation, an ice-detaching time period of the ice-detaching operation may become shorter as the water supply temperature increases.

Efficiency of an ice-making operation may increase as a required ice-making time period decreases, and efficiency of an ice-detaching operation may increase as an ice-detaching time period decreases. In harsh environments, such as when an ambient temperature around the icemaker is too low, when the water supply temperature is too low, or the like, a temperature during the ice-detaching operation may not be sufficiently high. At this time, if the ice-detaching operation is performed in the same manner as before, the ice on the cold plate may not be completely separated from the cold plate, in an ice-making operation of the next cycle, ice may further be made on or around the previously made ice on the cold plate, not separated from the cold plate in the previous cycle, the cold plate may be entirely frozen, and the ice overall may thus not be completely separated from the cold plate during the ice-detaching operation.

As a result, functions of the icemaker may be lost to cause a failure of the icemaker. If an ambient temperature around the icemaker or a water supply temperature of water to be supplied is too low, there may be a problem in that the ice overall may not be completely separated from the cold plate during the ice-detaching operation. That is, there may be a need to perform a modified ice-detaching operation in response to a change in an environmental condition to completely separate the ice overall from the cold plate during the ice-detaching operation.

In the meantime, if the ice-detaching temperature is too high in the ice-detaching operation, a problem may occur in an ice-making operation of the next cycle. Therefore, there may be a need to manage the ice-detaching temperature not to be too high.

SUMMARY

An aspect of the present disclosure provides a method of controlling an ice-detaching temperature of an icemaker, capable of changing an operation of an ice-making water pump and an ice-detaching time period at the same time without affecting an ice-making operation of the next cycle, to completely separate ice from a cold plate during an ice-detaching operation under conventional temperature conditions as well as even under harsh environments.

According to an aspect of the present disclosure, a method of controlling an ice-detaching temperature of an icemaker, includes a first step of performing an ice-making operation in an ice-making unit, and counting a required ice-making time period from a starting point in time of the ice-making operation to an end point in time of the ice-making operation; a second step of acquiring the counted required ice-making time period, and acquiring an ambient temperature from an external temperature sensor; a third step of determining a variable ice-detaching time period, depending on the acquired ambient temperature and the acquired required ice-making time period; and a fourth step of using the determined ice-detaching time period to perform an ice-detaching operation.

According to an aspect of the present disclosure, in the method, the third step may include determining whether the acquired ambient temperature and the acquired required ice-making time period are within a set ambient temperature range and a set required ice-making time period range to acquire a determination result, and determining a variable ice-detaching time period, depending on the acquired determination result.

In particular, in the method, the third step may include determining to elongate the ice-detaching time period, when the acquired ambient temperature is lower than a first temperature; and determining to shorten the ice-detaching time period, when the acquired ambient temperature is equal to or higher than the first temperature.

Alternatively, in the method, the third step may include determining to elongate the ice-detaching time period, when the acquired required ice-making time period is outside of the set required ice-making time period range; and determining to shorten the ice-detaching time period, when the acquired required ice-making time period is within the set required ice-making time period range.

According to another aspect of the present disclosure, in the method, the fourth step may include counting the determined ice-detaching time period from a sensation point in time, when it is sensed if a refrigerant temperature sensed by an evaporator sensor installed in an outlet pipe of an evaporator reaches a set refrigerant temperature; performing an operation of an ice-making water pump to prevent an increase in evaporator temperature, when the refrigerant temperature reaches a second temperature during the ice-detaching time period; and turning off the operation of the ice-making water pump, when the refrigerant temperature reaches a third temperature during the ice-detaching time period.

According to an aspect of the present disclosure, the method may further include additionally determining whether the required ice-making time period is outside of a set required ice-making time period range in the ice-making operation of a previous cycle, when the acquired required ice-making time period is outside of the set required ice-making time period range in the third step, and the ice-detaching operation is completed, wherein an error sign is displayed and driving of the icemaker may be stopped, when it is detected that the required ice-making time period has continuously exceeded the set required ice-making time period range at least two times. When required ice-making time periods are continuously outside of a set required ice-making time period, ice on a cold plate may not be completely separated from the cold plate. Therefore, when an ice-making operation and an ice-detaching operation are continuously performed, the cold plate overall may be frozen to cause a failure of the icemaker.

In particular, according to an aspect of the present disclosure, in the method, the starting point in time of the ice-making operation may be calculated from a point in time at which the ice-detaching time period has elapsed, and the end point in time of the ice-making operation may be sensed, when a water level in a water supply tank reaches a set water level or lower, wherein the first step may continuously perform the counting of the required ice-making time period and the ice-making operation, when the water level in the water supply tank does not reach the set water level or lower.

Further, in the method, the fourth step may further include performing the operation of ice-making water pump in the last section of the ice-detaching time period; and supplying water used for ice-making in the ice-detaching operation, after the ice-making operation is completed.

According to another aspect of the present disclosure, in the method, the third step may further include acquiring a water supply temperature of water supplied to a water supply tank, to determine an ice-detaching time period according to the water supply temperature, wherein it is determined to elongate the ice-detaching time period, when the acquired water supply temperature is lower than a target temperature, and it is determined to shorten the ice-detaching time period, when the water supply temperature is equal to or higher than the target temperature. Since the ice-detaching time period may be determined in consideration of not only the ambient temperature and the required ice-making time period, but also the water supply temperature, efficiency of the icemaker may further increase.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
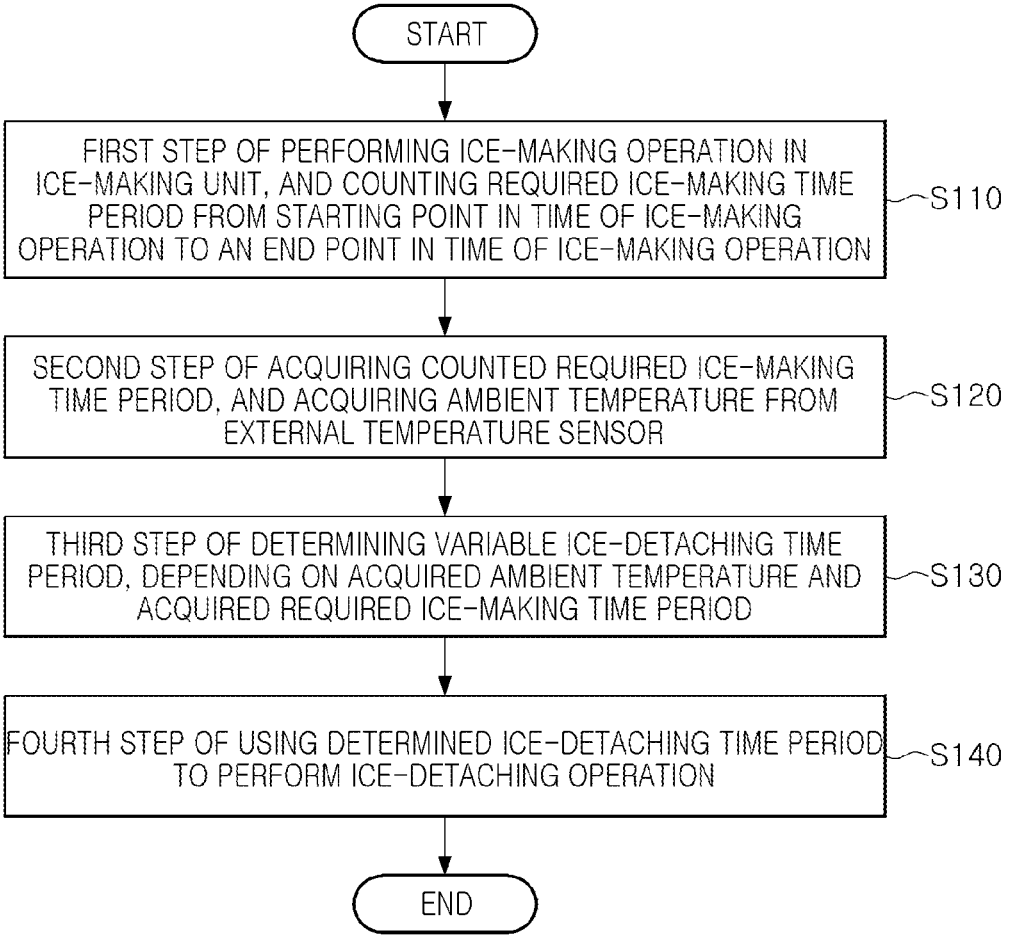
FIG. 1 is a flowchart illustrating a method for controlling an ice-detaching temperature of an icemaker according to the present disclosure.

Hereinafter, embodiments will be described in detail, examples of which are illustrated in the drawings. The examples described in the embodiments below have been described only in forms of essential configurations or steps for explanation, and do not represent all examples consistent with the present disclosure, and include examples in which other configurations or steps are added. On the contrary, these examples are only examples of methods consistent with some aspects of the present disclosure as detailed in the claims.

Hereinafter, for example, the expressions "in ~ing . . . ,", "when . . . ," or "in (a) case (of) . . . " may be interpreted as "if (or in a case in which) . . . ", "in response to confirmation of . . . " or "in response to determination of . . . "

Hereinafter, the expression of "counting an ice-detaching time period" or "counting an ice-detaching time period is counted" may refer that, for example, when an ice-detaching time period is 10 seconds, point in times, e.g., 10 seconds, 9 seconds, . . . 1 second of the ice-detaching time period are continuously and gradually counted before reaching zero (0) second. The expression of "an ice-detaching time period has elapsed" may refer that, for example, when an ice-detaching time period is 10 seconds, no ice-detaching time period remains, after reaching zero (0) second to end the counting of the ice-detaching time period.

As illustrated in FIG. 1, a method 100 of controlling an ice-detaching temperature of an icemaker, according to an embodiment of the present disclosure, may include a first step of performing an ice-making operation in an ice-making unit, and counting a required ice-making time period from a starting point in time of the ice-making operation to an end point in time of the ice-making operation(S110); a second step of acquiring the counted required ice-making time period, and acquiring an ambient temperature from an external temperature sensor(S120); a third step of determining a variable ice-detaching time period, depending on the acquired ambient temperature and the acquired required ice-making time period(S130); and a fourth step of using the determined ice-detaching time period to perform an ice-detaching operation(S140).

In this regard, "the ice-detaching time period" may be a sum of a time period for heating a refrigerant to reach a preset temperature at the end point in time of the ice-making operation and a time period for waiting for a preset time period after reaching the preset temperature, and, hereinafter, "the variable ice-detaching time period" may be defined as a time period for waiting for a determined time period after reaching the preset temperature. Therefore, an ice-detaching operation may be performed for a longer time period, as compared to a determined ice-detaching time period, Specifically, in S110, the starting point in time of the ice-making operation may be calculated from a point in time at which the ice-detaching time period has elapsed, and the end point in time of the ice-making operation may be sensed when a water level in a water supply tank reaches a set water level or lower. In particular, it may be determined that the ice-making operation is completed, when a level sensor installed in the water supply tank senses if a water level in the water supply tank has reached a set water level or lower. In this case, when the water level in the water supply tank does not reach the set water level or lower, it may be determined that the ice-making operation has not ended, and the counting of the required ice-making time period and the ice-making operation may thus be continued.

Figure 2:
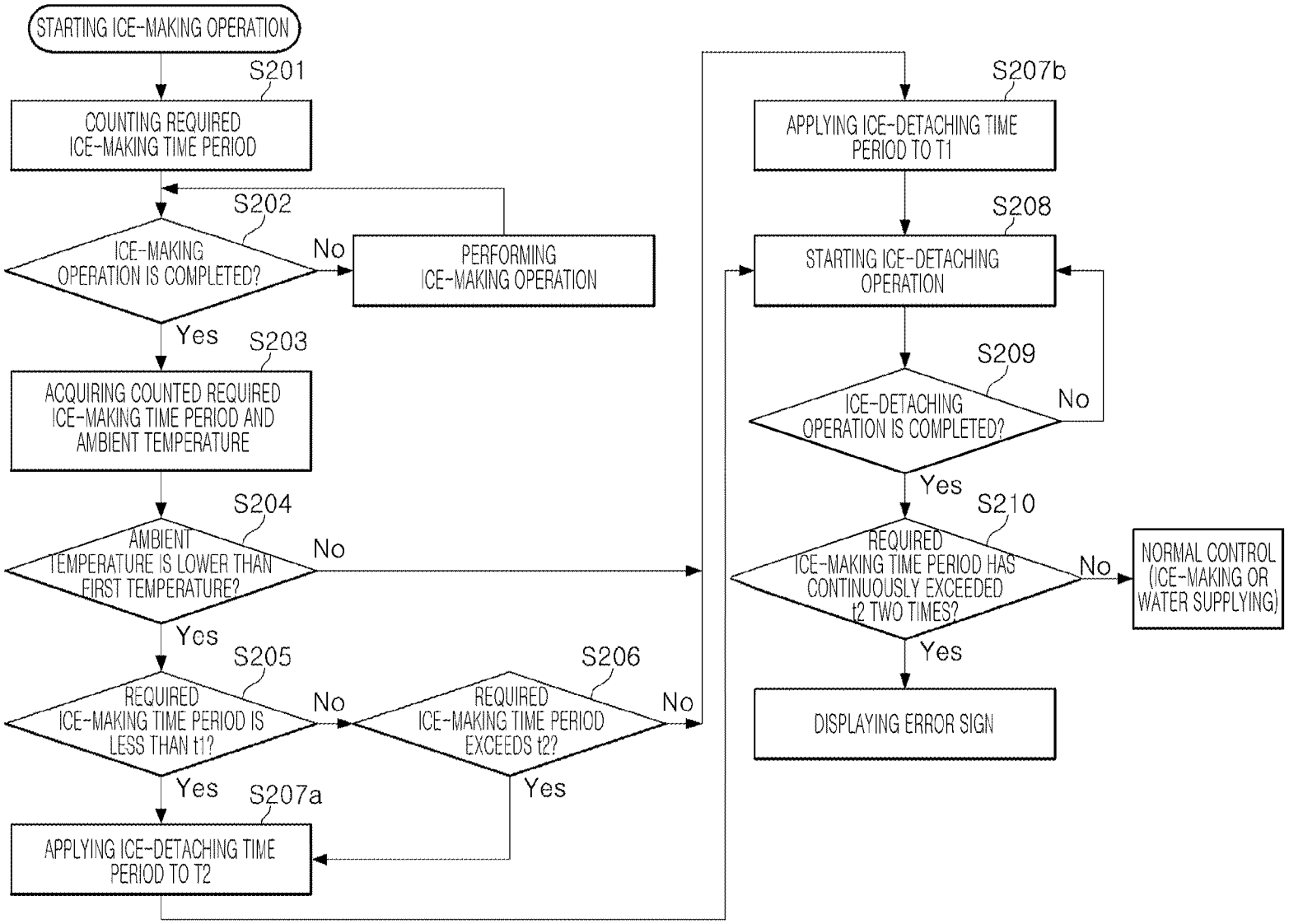
FIG. 2 is a flowchart illustrating a method for controlling an ice-detaching temperature of an icemaker according to an embodiment of the present disclosure, according to an ambient temperature and a required ice-making time period.

FIG. 2 is a flowchart illustrating S120 and S130, in detail, according to an embodiment of the present disclosure. As illustrated in FIG. 2, when the ice-making operation starts, the required ice-making time period may be counted from the starting point in time of the ice-making operation (S201), and, at the same time as the counting, it may be determined whether the ice-making operation is completed (S202).

As described above, the end of the ice-making operation may refer that the end time period of the ice-making operation has been reached, sensed if a water level in the water supply tank reaches the set water level or lower by the level sensor installed in the water supply tank. When the ice-making operation is completed (S202), the counting of the required ice-making time period may end, and the next step may be performed. When the end time period of the ice-making operation has not been reached, the counting of the required ice-making time period and the ice-making operation may be continued.

As illustrated in FIG. 2, when the ice-making operation is completed (S202), the counting of the required ice-making time period may end to acquire the required ice-making time period, and the external temperature sensor outside the icemaker may acquire the ambient temperature (S203).

Next, according to an embodiment of the present disclosure, the third step (S130) may include determining whether the acquired ambient temperature and the acquired required ice-making time period are within a set ambient temperature range and a set required ice-making time period range to acquire a determination result, and determining a variable ice-detaching time period, depending on the acquired determination result.

Specifically, the third step (S130) may include determining to elongate the ice-detaching time period, when the acquired ambient temperature is lower than a first temperature; and determining to shorten the ice-detaching time period, when the acquired ambient temperature is equal to or higher than the first temperature. Alternatively, the third step (S130) may include determining to elongate the ice-detaching time period, when the acquired required ice-making time period is outside of the set required ice-making time period range; and determining to shorten the ice-detaching time period, when the acquired required ice-making time period is within the set required ice-making time period range. The set required ice-making time period may refer to an optimal required ice-making time period range for performing an ice-making operation.

For example, the ice-detaching time period may be changed to give a sufficient time period to reach an ice-detaching temperature at which ice is separated from the cold plate. In this case, the ice-detaching time period may be determined only by the ambient temperature. Alternatively, the ice-detaching time period may be determined only by the required ice-making time period. Alternatively, the ice-detaching time period may be determined in consideration of the ambient temperature and the required ice-making time period.

For example, as illustrated in FIG. 2, it may be determined whether the ambient temperature acquired in S203 is lower than the first temperature (S204). In this case, when the ambient temperature is lower than the first temperature, it may be determined whether the required ice-making time period acquired in S203 is less than t1 (S205) and whether the required ice-making time period acquired in S203 exceeds t2 (S206), to determine an ice-detaching time period in consideration of both the ambient temperature and the required ice-making time period.

As illustrated in FIG. 2, when the icemaker is provided under a harsh environment in which the ambient temperature is very low, it may be difficult to increase a temperature of the cold plate to separate ice from the cold plate. Therefore, a relatively long ice-detaching time period may be required. In this case, when the ambient temperature is lower than the first temperature (YES), an ice-detaching time period may be additionally determined in consideration of the required ice-making time period. When the ambient temperature is equal to or higher than the first temperature (NO), refrigerant temperature may easily reach the ice-detaching temperature. Therefore, a short ice-detaching time period T1 may be applied, the first temperature may be 18° C., and T1 may be 120 seconds.

In addition, when the ambient temperature is lower than the first temperature, and the required ice-making time period is less than t1 (YES), a long ice-detaching time period T2 may be applied. When the required ice-making time period is equal to or greater than t1 (NO), and the required ice-making time period exceeds t2 (YES), a long ice-detaching time period T2 may also be applied. In this case, the first temperature may be 18° C., and T2 may be 480 seconds. When the ambient temperature is too low, a time period for the water supply temperature to reach zero (0) degrees may be short, and as a result, the required ice-making time period may be also shortened. Therefore, when the required ice-making time period is less than the set t1, there may be a need to have a long time period enough to increase a temperature for performing the ice-detaching operation.

When the ambient temperature is too low, ice generated on the cold plate may not be separated from the cold plate. In this case, when further ice is made on or around the previously made ice, not separated from the cold plate, a water level in the water tank may not be reduced in a normal speed, and the required ice-making time period may become longer than a normal range. Therefore, even when the required ice-making time period exceeds the set t2, there may be a need to have a long ice-detaching time period enough to separate the ice from the cold plate and smoothly perform ice-making and ice-detaching operations.

Therefore, when the required ice-making time period is less than t1 or exceeds t2, a long ice-detaching time period T2 (for example, 480 seconds) may be applied (S207*a*) and when the required ice-making time period is within t1 to t2, and the ambient temperature is lower than the first temperature, a short ice-detaching time period T1 (for example, 120 seconds) may be applied (S207*b*). In this case, since the set optimal required ice-making time period range may be t1 to t2, and may satisfy $t1 \leq t2$. When $t1=t2$, the variable ice-detaching time period may be determined by determining whether the required ice-making time period is an optimal set required ice-making time period value, not by whether the required ice-making time period is within an optimal set required ice-making time period range. For example, t1 may be 21 minutes.

As illustrated in FIG. 2, when the ice-detaching time period is determined, an ice-detaching operation may start (S208), and it may be determined whether the ice-detaching operation is completed (S209). In this case, when it is determined whether the ice-detaching operation is completed because the ice-detaching time period has elapsed (YES), it may be determined whether the required ice-making time period has continuously exceeded t2 two times (S210), According to an embodiment of the present disclosure, additionally determining whether the required ice-making time period is outside of the set required ice-making time period range (t1 to t2) in the ice-making operation of the previous cycle, when the acquired required ice-making time period is outside of the set required ice-making time period range in the third step (S130), and the ice-detaching operation is completed (S209) may be further included, wherein an error sign may be displayed and driving of the icemaker may be stopped, when it is detected that the required ice-making time period has continuously exceeded the set required ice-making time period range at least two times (S210).

As illustrated in FIG. 2, it may be determined whether the required ice-making time period has continuously exceeded t2 two times (210). In this case, when it is detected that the required ice-making time period has continuously exceeded the set required ice-making time period range two times (YES), an error sign may be displayed and driving of the icemaker may be stopped. When it is detected that the required ice-making time period has continuously not exceeded the set required ice-making time period range two times (NO), an ice-making operation of the next cycle may be performed as it is. This may be because the ice on the cold plate may not be completely separated when the required ice-making time period is continuously outside of the set required ice-making time period range (t1 to t2), and the cold plate may then be entirely frozen to cause a failure of the icemaker when the ice-making and ice-detaching operations are continued as they are.

In addition, according to another embodiment of the present disclosure, the third step (S130) may further include acquiring a water supply temperature of water supplied to a water supply tank, to determine an ice-detaching time period according to the water supply temperature wherein it may be determined to elongate the ice-detaching time period, when the acquired water supply temperature is lower than a target temperature, and it may be determined to shorten the ice-detaching time period, when the water supply temperature is equal to or higher than the target temperature.

The ice-detaching time period may be determined in consideration of not only the ambient temperature and the required ice-making time period, but also the water supply temperature, to further increase efficiency of the icemaker.

According to an embodiment of the present disclosure, the fourth step (S140) may further include counting the determined ice-detaching time period from a sensation point in time, when it is sensed if a refrigerant temperature sensed by an evaporator sensor 405 installed in an outlet pipe of an evaporator 401 reaches a set refrigerant temperature; performing an operation of an ice-making water pump 403 to prevent an increase in evaporator temperature, when the refrigerant temperature reaches a second temperature during the ice-detaching time period; and turning off the operation of the ice-making water pump 403, when the refrigerant temperature reaches a third temperature during the ice-detaching time period.

In addition, the fourth step (S140) may further include performing the operation of the ice-making water pump 403 in the last section of the required ice-making time period, and may further include supplying water used for ice-making in the ice-detaching operation, after the ice-making operation is completed.

Figure 3:
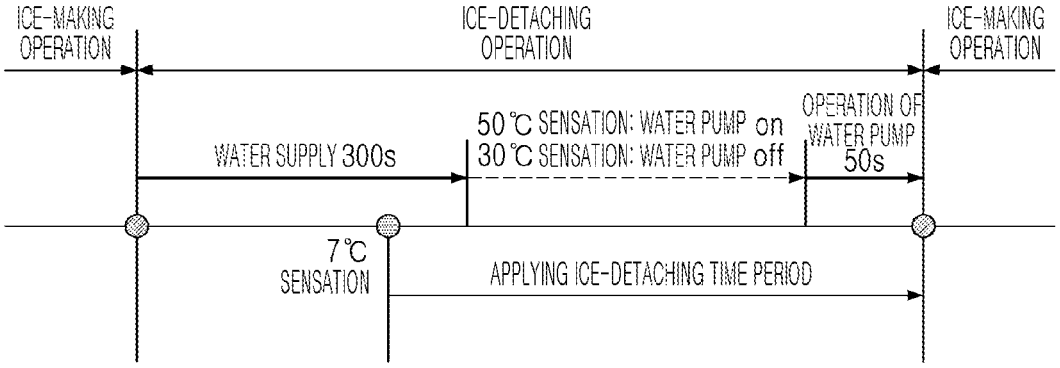
FIG. 3 is a view illustrating an operation of a method for controlling an ice-detaching temperature of an icemaker according to an embodiment of the present disclosure, according to a temperature of a refrigerant.
Figure 4:
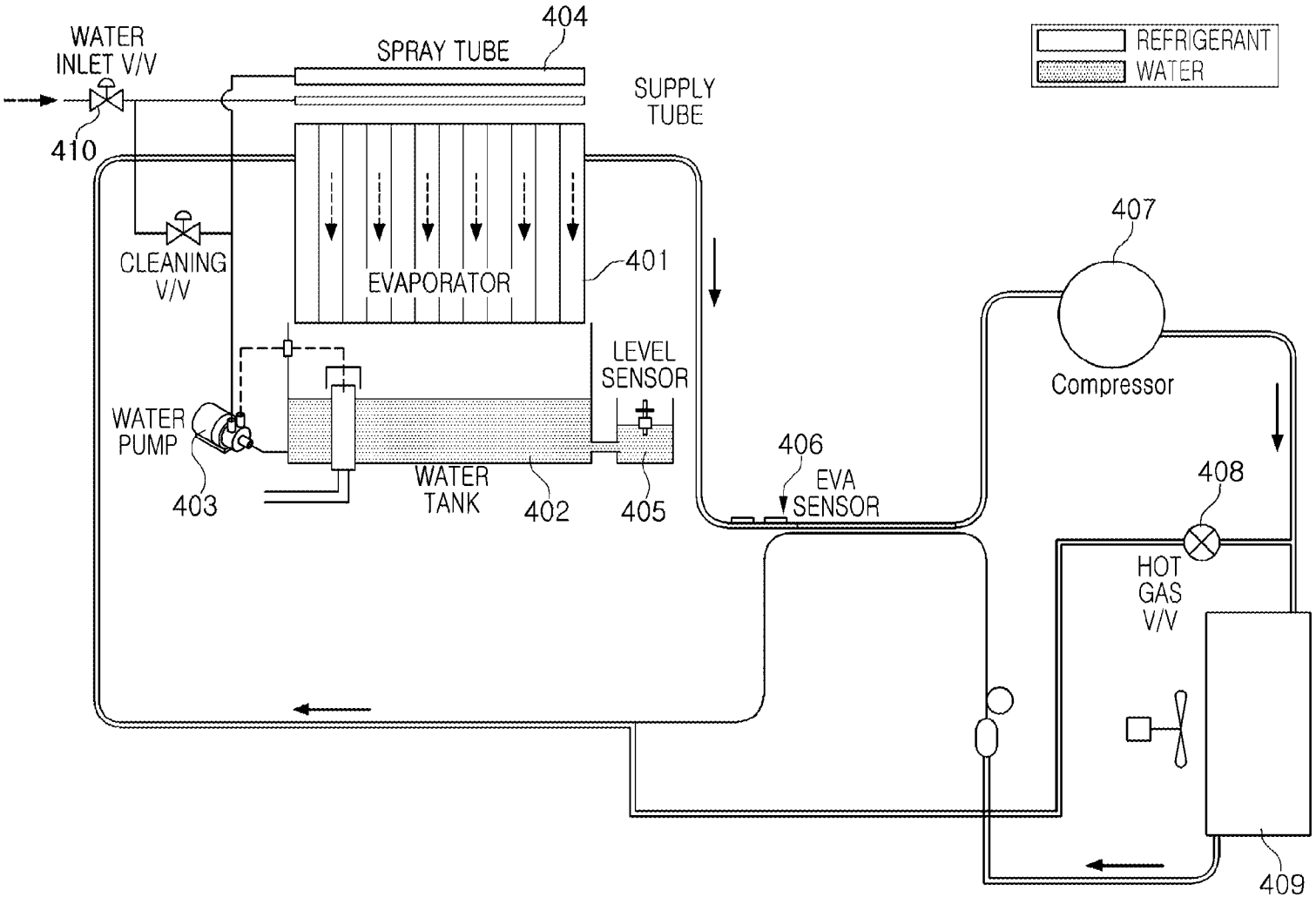
FIG. 4 is a block diagram illustrating a schematic configuration of an icemaker according to an embodiment of the present disclosure.

As illustrated in FIGS. 3 and 4, water may be supplied from a water inlet valve 410 into a water tank 402, When an ice-making water pump 403 is operated, the water in the water tank 402 may flow through a spray tube 404, and may be supplied to a cold plate on which an evaporator 401 is located. Water may flow in a downward direction due to gravity, ice may be generated on the cold plate by a cold refrigerant passing through the evaporator 401. When a water level in the water tank 402 decreases to a certain level or lower, a level sensor 405 may detect this water level, and may end an ice-making operation.

Then, an ice-detaching operation may start. A determined ice-detaching time period may not proceed immediately. When a temperature of an evaporator sensor 406 installed in an outlet pipe of the evaporator 401 reaches a set temperature, the determined ice-detaching time period may proceed. As illustrated in FIG. 3, when the evaporator sensor 406 detects 7° C., the determined ice-detaching time period, for example, an ice-detaching time period T1 or an ice-detaching time period T2 may proceed. When the level sensor 405 detects a relatively low water level, a hot gas valve 408 may open and a liquid valve may close, to provide a time period for supplying a high-temperature refrigerant to the evaporator 401.

In this case, after the ice-making operation is completed, a step of supplying water used for ice-making in the ice-making operation may be further included. Since a temperature of water is higher than a temperature of ice, water to be used in the ice-making operation may be supplied, in advance, to induce an increase in a temperature of the cold plate. In addition, the ice-making water pump 403 may operate in the last section of the ice-detaching time period. Before starting the ice-making operation, since a temperature of water is lower than a temperature of a refrigerant, the ice-making water pump 403 may be driven to lower the temperature of the cold plate.

As illustrated in FIG. 3, except for supplying water to be used for ice-making during the ice-detaching operation overall or performing an operation of the ice-making water pump 403 in the last section of the ice-detaching time period, an empty time period that does not perform any operation during the ice-detaching time period may be present (e.g., an arrow section). Since a high-temperature refrigerant may be continuously supplied to the cold plate during the empty time period, a temperature of the evaporator 401 may increase excessively, and a problem may occur in the next ice-making operation.

Therefore, as illustrated in FIG. 3, a refrigerant temperature may be acquired through the evaporator sensor 406 in the outlet pipe of the evaporator 401 during the ice-detaching time period. In this case, when it is sensed if the refrigerant temperature has reached a second temperature, for example, 50° C., an operation of the ice-making water pump 403 may be performed to supply low-temperature water to the cold plate, to lower an excessively increased temperature of the cold plate. In addition, when it is sensed if the temperature of the cold plate, reached 50° C., is lowered and reaches a third temperature, for example, 30° C., the operation of the ice-making water pump 403 may be turned off.

For the ice-detaching operation, the operation of the ice-making water pump 403 may be controlled, depending on the second temperature or the third temperature, to increase a temperature of the cold plate during the ice-detaching time period, prevent an excessively increase in the temperature of the cold plate to maintain durability of the icemaker, and smoothly perform an ice-making operation of the next cycle.

According to the present disclosure described above, while performing an ice-detaching operation of an icemaker, a variable required ice-detaching time period may be determined by an ambient temperature and a required ice-making time period counted in the ice-making operation, water to be used in the ice-making operation may be supplied in advance, and a water pump used for ice-making may be driven to control an ice-detaching temperature. The ice-making operation may decrease a temperature of a cold plate, and the ice-detaching operation may increase the decreased temperature of the cold plate. Therefore, balance in function of the icemaker for increasing efficiency of the icemaker may be maintained, to maximize the efficiency of the icemaker, prevent a failure of the icemaker, and increase durability of the icemaker.

According to an embodiment of the present disclosure, an icemaker may be configured to detect whether an acquired ambient temperature and an acquired required ice-making time period are within set ranges thereof to determine a variable ice-detaching time period depending on a determination result, and perform an ice-detaching operation using the determined ice-detaching time period to completely separate ice overall from a cold plate during the ice-detaching operation even under changes in surrounding environmental conditions, to prevent a failure of an icemaker.

In addition, an ice-making water pump may be controlled not to affect the next ice-making operation due to too high refrigerant temperature during an ice-detaching operation, to maintain an optimum ice-making temperature and maintain durability of an icemaker for a relatively long time period.

While example embodiments have been illustrated and described above, it will be apparent to those skilled in the art that modifications and variations could be made without departing from the scope of the present disclosure as defined by the appended claims.

What is claimed:

1. A method of controlling an ice-detaching temperature of an icemaker, which includes a water supply tank and an ice-making unit that repeats an ice-making operation and an ice-detaching operation, the method comprising:

a first step of performing the ice-making operation in the ice-making unit until a water level in the water supply tank reaches a set water level;

a second step of acquiring an ice-making time period required to perform the ice-making operation of a corresponding cycle, and acquiring an ambient temperature from an external temperature sensor;

a third step of determining an ice-detaching time period of the ice-detaching operation of the corresponding cycle, based on the acquired ambient temperature and the acquired ice-making time period, wherein the ice-detaching operation includes a heating time period and the ice-detaching time period, wherein the heating time period is for heating a refrigerant to a preset temperature and starts at an end of the ice-making time period, and wherein the ice-detaching time period starts at an end of the heating time period and after reaching the preset temperature;

a fourth step of performing the ice-detaching operation of the corresponding cycle based on the determined ice-detaching time period;

a fifth step of determining whether a previous ice-making time period acquired from a previous cycle of the corresponding cycle is outside the set ice-making time period based on the acquired ice-making time period being outside of the set ice-making time period; and a sixth step of displaying an error sign and stopping the icemaker based on the previous ice-making time period being outside the set ice-making time period and the acquired ice-making time period being continuously outside the set ice-making time period for at least two times, wherein the third step further comprises:

determining the ice-detaching time period of the ice-detaching operation within the corresponding cycle in which the required ice-making time period is obtained, based on whether the acquired ice-making time period is within a set ice-making time period, wherein the set ice-making time period is greater than or equal to t1, and less than or equal to t2, and wherein t1 is less than or equal to t2;

extending the ice-detaching time period, when the acquired ice-making time period is outside of the set ice-making time period; and at least one of maintaining or reducing the ice-detaching time period, when the acquired ice-making time period is within the set ice-making time period.

2. The method of claim 1, wherein the third step further comprises:

determining the ice-detaching time period based on whether the acquired ambient temperature is within a set ambient temperature range;

extending the ice-detaching time period, when the acquired ambient temperature is less than a first temperature; and at least one of maintaining or reducing the ice-detaching time period, when the acquired ambient temperature is equal to or greater than the first temperature.

3. The method of claim 1, wherein the fourth step further comprises:

counting the determined the ice-detaching time period from a time when a refrigerant temperature sensed by an evaporator sensor installed in an outlet pipe of an evaporator reaches a set refrigerant temperature;

performing an operation of an ice-making water pump to prevent an increase in evaporator temperature when the refrigerant temperature reaches a second temperature during the ice-detaching time period; and turning off the ice-making water pump when the refrigerant temperature reaches a third temperature during the ice-detaching time period.

4. The method of claim 3, wherein the fourth step further comprises operating an ice-making water pump in a last section of the ice-detaching time period.

5. The method of claim 3, wherein the fourth step further comprises supplying water used for ice-making in the ice-detaching operation, after the ice-making operation is completed.

6. The method of claim 1, wherein the required ice-making time period and the ice-making operation are continuously counted when the water level in the water supply tank does not reach the set water level.

7. The method of claim 1, wherein the third step further comprises:

acquiring a temperature of water supplied to a water supply tank;

determining an ice-detaching time period based on the water supply temperature;

extending the ice-detaching time period when the acquired temperature of the water is lower than a target temperature; and reducing the ice-detaching time period when the acquired temperature of the water is equal to or greater than the target temperature.

* * * * *